US007513817B2

(12) United States Patent
Cheng

(10) Patent No.: US 7,513,817 B2
(45) Date of Patent: Apr. 7, 2009

(54) BRASSIERE WITH CUP EDGE ENHANCING STRUCTURE

(75) Inventor: Liza Cheng, Shenzhen (CN)

(73) Assignee: Embry (China) Garments Ltd., Shenzhen (CN)

( * ) Notice: Subject to any disclaimer, the term of this patent is extended or adjusted under 35 U.S.C. 154(b) by 529 days.

(21) Appl. No.: 11/095,082

(22) Filed: Mar. 30, 2005

(65) Prior Publication Data

US 2005/0272344 A1 Dec. 8, 2005

(30) Foreign Application Priority Data

Jun. 4, 2004 (CN) ..... 2004 2 0046762

(51) Int. Cl.
*A41C 3/00* (2006.01)

(52) U.S. Cl. ..... 450/92; 450/93; 2/274; 2/275

(58) Field of Classification Search ..... 450/92, 450/93; 2/244, 246, 24, 3.1, 274, 275
See application file for complete search history.

(56) References Cited

U.S. PATENT DOCUMENTS 2,245,095 A * 6/1941 Nordseth ..... 139/384 R
3,410,742 A * 11/1968 Anderberg ..... 156/196
3,449,765 A * 6/1969 Beard et al. ..... 2/113
6,000,994 A * 12/1999 Salotto ..... 450/92
6,645,040 B2 * 11/2003 Rabinowicz et al. ..... 450/1

* cited by examiner

*Primary Examiner*—Gloria Hale
(74) *Attorney, Agent, or Firm*—Raymond Y. Chan; David and Raymond Patent Firm

(57) ABSTRACT

A brassiere includes an article of underwear, two bra cups, and a cup edging enhancement substantially attaching the bra cups to the underwear. Each bra cup includes an outer layer and an inner lining overlapped thereto that a lining brim of the inner lining is misaligned with a layer brim of the outer layer to form a seaming portion at the inner lining. The seaming portion of each of the bra cups is overlappedly attached on the respective edge portion of the underwear while the layer brim of the outer layer is alignedly affixed to the respective bordering edge of the underwear in an edge-to-edge manner for substantially reducing a thickness of a seam between the bra cup and the underwear so as to avoid the visibility of the contour of the seam of the brassiere especially when the brassiere is worn underneath the clingy clothes.

20 Claims, 2 Drawing Sheets

BRASSIERE WITH CUP EDGE ENHANCING STRUCTURE

BACKGROUND OF THE PRESENT INVENTION

1. Field of Invention

The present invention relates to an underwear garment, and more particularly to a brassiere with a cup edge enhancing structure to provide improved comfort when worn while proving an adequate natural appearance.

2. Description of Related Arts

The design of the brassiere underwear garment, serves a sense of intimacy and provides a breast enclosure and support. The brassiere generally comprises an article of under wear with a brasserie body portion including a body encircling band, and two bra cups spacedly attached thereto for enclosing and supporting the breasts of the wearer. Accordingly, in order to attach the bra cup to the bra body and bra body encircling band, an edge of the bra body and bra body encircling band is overlappedly stitched along a brim of the bra cup to form a stitching seam. However, such stitching structure of the brassiere will thicken the stitching seam so that the wearer may feel uncomfortable when she wears the brassiere. In addition, such brassieres are unattractive since the stitching seam is visibly exposed when the brassiere is worn underneath a clingy outerwear. In other words, such brassiere will detract from the smooth, since the contours of the bra cups are inevitably visible underneath.

SUMMARY OF THE PRESENT INVENTION

A main object of the present invention is to provide a brassiere with cup edge enhancing structure which provides a smooth thin edging of the bra cup to enhance a comfortable wearing experience, pleasing appearance and a natural look.

In order to accomplish the above object, the present invention provides a brassiere, comprising:

an article of underwear brasserie adapted for a wearer to wear on her body, wherein the brasserie has a brasserie body and circumferential body band, wherein the brasserie circumferential body band has two edge portions and two bordering edges extending therealong respectively;

two bra cups, each of which comprises an outer layer having a outer layer brim and an inner lining having an lining brim, wherein the inner lining is overlapped on the outer layer such that the lining brim is misaligned with the layer brim to form a seaming portion at the inner lining between the layer brim and the lining brim; and a cup edging enhancement substantially attaching the bra cups to the brasserie body band, wherein the seaming portion of each of the bra cups is overlappedly attached on the respective cup edge portion of the brasserie body band while the layer brim of the outer layer is alignedly affixed to the respective bordering edge of the brasserie body band in an edge-to-edge manner so as to substantially reduce a thickness of a seam between the bra cup and the brasserie body band.

These and other objectives, features, and advantages of the present invention will become apparent from the following detailed description, the accompanying drawings, and the appended claims.

DETAILED DESCRIPTION OF THE PREFERRED EMBODIMENTS

Referring to FIGS. 1 to 4 of the drawings, a brassiere with a cup edge enhancing structure is illustrated.

Figure 1:
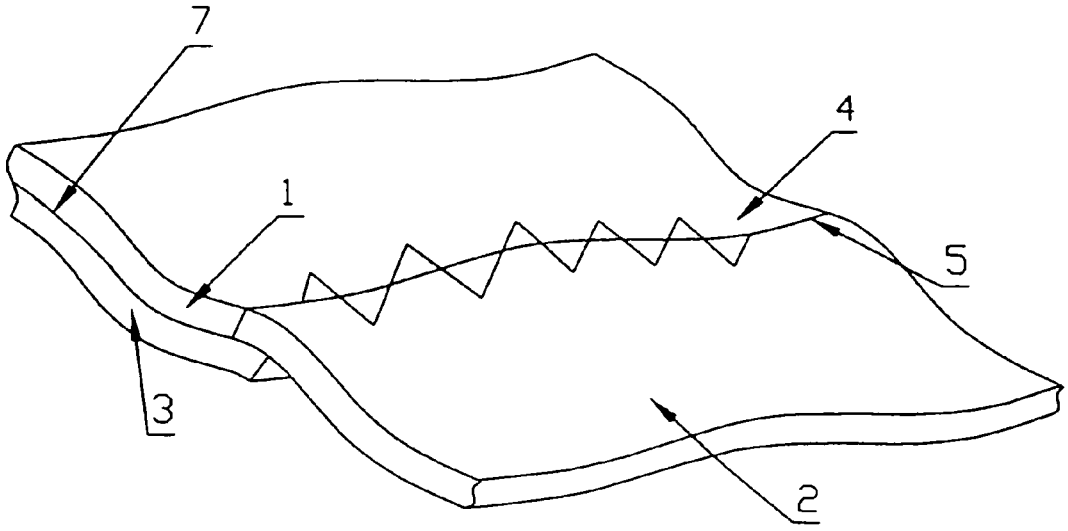
FIG. 1 is a partially perspective view of a cup edge enhancing structure of a brassiere according to a preferred embodiment of the present invention.
Figure 4:
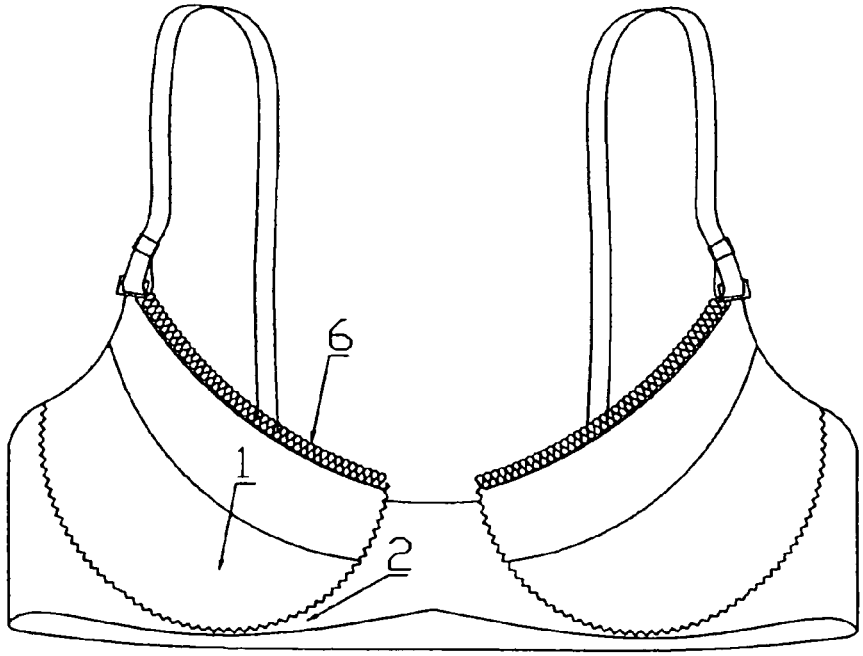
FIG. 4 is a perspective view of the brassiere with the cup edge enhancing structure according to the above preferred embodiment of the present invention.

FIGS. 1 and 4 illustrate a preferred embodiment of the cup edge enhancing structure of the brassiere.

According to the preferred embodiment, the brassiere comprises two bra cups 7 and an brasserie body portion with body encircling band 6 adapted for a wearer wearing on her body wherein the underwear 6 has two cup edge portions 2 and two cup bordering edges 5 extending therealong respectively. Each of the bra cups 7 comprises an outer layer 1 having a layer brim and an inner lining 3 having an lining brim, wherein the inner lining 3 is overlapped on the outer layer 1 that the lining brim is misaligned with the layer brim to form a seaming portion at the inner lining between the layer brim and the lining brim. The brassiere further comprises a cup edging enhancement substantially attaching the bra cups 7 to the brasserie body portion with body encircling band 6, wherein the seaming portion of each of the bra cups 7 is overlappedly attached on the respective cup edge portion 2 of the brasserie body portion with body encircling band 6 while the layer brim of the outer layer 1 is alignedly affixed to the respective cup bordering edge 5 of the brasserie body portion with body encircling band 6 in an edge-to-edge manner so as to substantially reduce a thickness of a seam between the bra cup 7 and the brasserie body portion with body encircling band 6. Accordingly, the cup edging enhancement comprises at least a stitching line 4, which is a zigzag sewing line, stitched at the outer layer 1 and the brasserie body portion with body encircling band 6 to securely affix the layer brim of the outer layer 1 with the cup bordering edge 5 of the brasserie body portion with body encircling band 6 in an edge-to-edge manner and to overlapped affix the seaming portion of the bra cup 7 to the cup edge portion 2 of the brasserie body portion with body encircling band 6, so as to substantially retain the bra cups 7 in position. As shown in FIG. 4, the brassiere provides an even thickness seam connection between the bra cup 7 and the brasserie body portion with body encircling band 6 by overlapping the seaming portion of each of the bra cups 7 with the respective cup edge portion 2 of the brasserie body portion with body encircling band 6, so as to reduce the thickness of the seam between the bra cup 7 and the brasserie body portion with body encircling band 6 for enhancing the comfortability of the brassiere. In other words, the seam of the bra cup 7 will not be visibly exposed even the brassiere is worn underneath a clingy outerwear. Accordingly, the bra cup 7 is embodied as a foaming cup, fabric filling cup or thick padding cup as the inner lining 3 while the cup edge portion 2 of the brasserie body portion with body encircling band 6 is embodied as a fabric cloth such as knit fabric or woven fabric.

Figure 2:
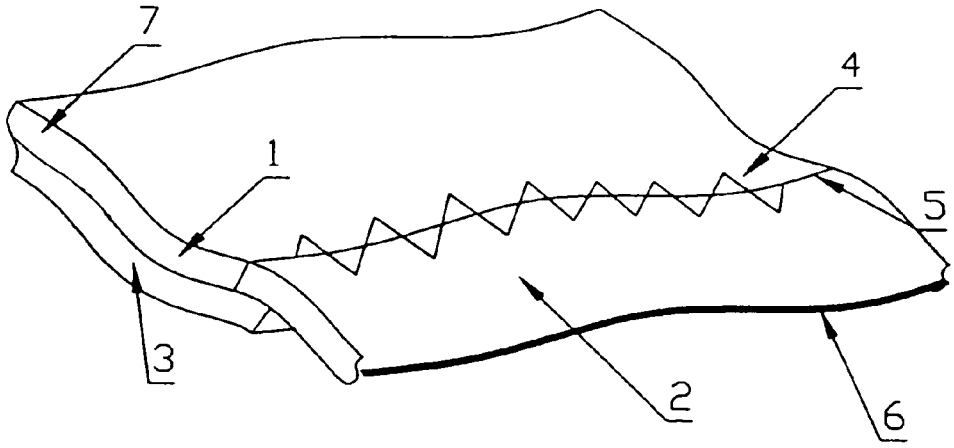
FIG. 2 illustrates a first alternative mode of the cup edge enhancing structure of the brassiere with the cup edge enhancing structure according to the above preferred embodiment of the present invention.

FIGS. 2 and 4 illustrate an alternative mode of the cup edge enhancing structure, which has the same structural configuration of the preferred embodiment.

The cup edge enhancing structure illustrates each of the bra cups 7 having a foaming cup to form a double-layer structure, wherein the decorative lace or embroidery is provided along each of the cup edge portions 2 of the brasserie body portion with body encircling band 6 to enhance the aesthetic appearance of the brassiere.

Figure 3:
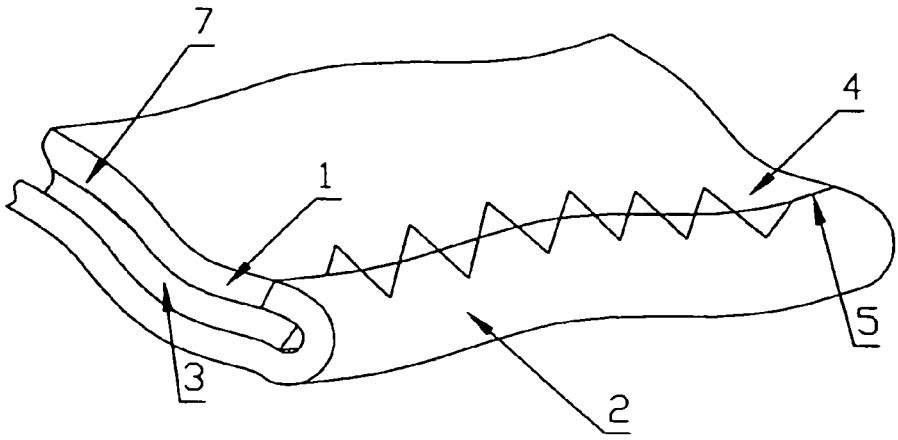
FIG. 3 illustrates a second alternative mode of the cup edge enhancing structure of the brassiere with the cup edge enhancing structure according to the above preferred embodiment of the present invention.

As shown in FIG. 3, another alternative mode of the cup edge enhancing structure of the brassiere illustrates the cup edge portion 2 of the brasserie body portion with body encircling band 6 overlappedly folding on the inner lining 3 to wrap and enclose the seaming portion of the bra cup 7 so as to provide a smooth flat border of the brassiere.

What is claimed is:

1. A brassiere, comprising:

a brassiere body including a circumferential body band worn about a wearer's torso wherein said brassiere body band has two cup edge portions and two cup bordering edges extending there along respectively;

two bra cups, each of which comprises an outer layer having an outer layer brim and an inner lining having a lining brim, wherein said inner lining of each of said outer layer is overlapped on said outer layer of said respective inner lining that said lining brim is misaligned with said outer layer brim to form a seaming portion at said inner lining between said outer layer brim and said lining brim; and a cup edging enhancement substantially attaching said bra cups to said underwear fabric, wherein said seaming portion of each of said bra cups is overlappedly attached on said respective edge portion of said underwear fabric while said outer layer brim of said outer layer is alignedly affixed to said respective bordering edge of said underwear fabric in an edge-to-edge manner so as to substantially reduce a thickness of a seam between said bra cup and said underwear fabric.

2. The brassiere, as recited in claim 1, wherein said cup edging enhancement comprises at least a stitching line stitched at said outer layer and said brassiere body band to securely affix said outer layer brim of said outer layer with said bordering edge of said brassiere body band in an edge-to-edge manner and overlapped to affix said seaming portion of said bra cup to said cup edge portion of said brassiere body band, so as to substantially retain said bra cups in position.

3. The brassiere, as recited in claim 2, wherein said stitching line is a zigzag sewing line.

4. The brassiere, as recited in claim 1, wherein said cup edge portion of said brassiere body band is overlappedly folded on said inner lining to wrap and enclose said seaming portion of said bra cup so as to provide a smooth flat border of said brassiere.

5. The brassiere, as recited in claim 2, wherein said cup edge portion of said brassiere body band is overlappedly folded on said inner lining to wrap and enclose said seaming portion of said bra cup so as to provide a smooth flat border of said brassiere.

6. The brassiere, as recited in claim 3, wherein said cup edge portion of said brassiere body band is overlappedly folded on said inner lining to wrap and enclose said seaming portion of said bra cup so as to provide a smooth flat border of said brassiere.

7. The brassiere, as recited in claim 1, wherein said bra cups are two foam cups while said cup edge portion of said brassiere body band is embodied as a fabric cloth stitched to said bra cups.

8. The brassiere, as recited in claim 3, wherein said bra cups are two foam cups while said cup edge portion of said brassiere body band is embodied as a fabric cloth stitched to said bra cups.

9. The brassiere, as recited in claim 6, wherein said bra cups are two foam cups while said cup edge portion of said brassiere body band is embodied as a fabric cloth stitched to said bra cups.

10. The brassiere, as recited in claim 1, wherein said bra cups have fibers filled therein while said cup edge portion of said brassiere body band is embodied as a fabric cloth stitched to said bra cups.

11. The brassiere, as recited in claim 3, wherein said bra cups have fibers filled therein while said cup edge portion of said brassiere body band is embodied as a fabric cloth stitched to said bra cups.

12. The brassiere, as recited in claim 6, wherein said bra cups have fibers filled therein while said cup edge portion of said brassiere body band is embodied as a fabric cloth stitched to said bra cups.

13. The brassiere, as recited in claim 1, wherein said bra cups have two pieces of thick padding formed therein respectively while said cup edge portion of said brassiere body band is embodied as a fabric cloth stitched to said bra cups.

14. The brassiere, as recited in claim 3, wherein said bra cups have two pieces of thick padding formed therein respectively while said cup edge portion of said brassiere body band is embodied as a fabric cloth stitched to said bra cups.

15. The brassiere, as recited in claim 6, wherein said bra cups have two pieces of thick padding formed therein respectively while said cup edge portion of said brassiere body band is embodied as a fabric cloth stitched to said bra cups.

16. The brassiere, as recited in claim 1, further comprising a decorative lace layer integrally formed along each of said cup edge portions of said brassiere body band to enhance an aesthetic appearance of said brassiere.

17. The brassiere, as recited in claim 6, further comprising a decorative lace layer integrally formed along each of said cup edge portions of said brassiere body band to enhance an aesthetic appearance of said brassiere.

18. The brassiere, as recited in claim 9, further comprising a decorative lace layer integrally formed along each of said cup edge portions of said brassiere body band to enhance an aesthetic appearance of said brassiere.

19. The brassiere, as recited in claim 12, further comprising a decorative lace layer integrally formed along each of said cup edge portions of said brassiere body band to enhance an aesthetic appearance of said brassiere.

20. The brassiere, as recited in claim 15, further comprising a decorative lace layer integrally formed along each of said cup edge portions of said brassiere body band to enhance an aesthetic appearance of said brassiere.

* * * * *